US006216788B1

(12) United States Patent
Wilson

(10) Patent No.: US 6,216,788 B1
(45) Date of Patent: Apr. 17, 2001

(54) SAND PROTECTION SYSTEM FOR ELECTRICAL SUBMERSIBLE PUMP

(75) Inventor: Brown Lyle Wilson, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/437,868

(22) Filed: Nov. 10, 1999

(51) Int. Cl.[7] ..... E21B 37/00; E21B 43/00
(52) U.S. Cl. ..... 166/311; 166/105.1
(58) Field of Search ..... 166/68, 105.1, 166/311, 312, 370, 105.3, 106

(56) References Cited

U.S. PATENT DOCUMENTS

| | | | | |
|---|---|---|---|---|
| Re. 35,453 | | 2/1997 | Cobb . | |
| 3,361,206 | | 1/1968 | Raulins . | |
| 3,963,073 | * | 6/1976 | Laval, Jr. | 166/105.1 |
| 4,223,724 | * | 9/1980 | Levoni et al. | 166/68 |
| 4,407,360 | | 10/1983 | Hamrick . | |
| 4,621,693 | * | 11/1986 | Caldwell et al. | 166/311 |
| 4,924,940 | * | 5/1990 | Burroughs et al. | 166/105.1 |
| 5,295,537 | | 3/1994 | Trainer . | |
| 5,314,018 | * | 5/1994 | Cobb | 166/265 |
| 5,553,669 | | 9/1996 | Trainer . | |
| 5,662,167 | | 9/1997 | Patterson et al. . | |

* cited by examiner

*Primary Examiner*—Frank Tsay
(74) *Attorney, Agent, or Firm*—Felsman, Bradley, Vaden, Gunter & Dillon, L.L.P.; James E. Bradley

(57) ABSTRACT

A method and apparatus for removing sand, which has been separated from well fluids, from a well bore. A separator is provided to separate sand from well fluids before the well fluids enter an electrical submersible pump (ESP). A bypass tube is connected from a flow conduit above the pump to a location below the ESP where the sand is collected. The ESP is turned off and the fluid levels within the flow conduit are allowed to equalize. The flow conduit is then pressurized at the surface to cause a downward flow of well fluid in the flow conduit below an equilibrium point for the well fluid. After lowering the level of fluid within the flow conduit, the pressure within the flow conduit is then relieved, which causes the well fluid to flow upwards through the bypass tube to the flow conduit. As a result, sand is drawn up the bypass tube into the flow conduit above the pump. A check valve prevents back-flow of sand through the bypass tube after the sand and fluid have flowed through the bypass tube into the flow conduit. The pump is then restarted and the sand and fluid located above the pump in the flow conduit is pumped to the surface.

19 Claims, 2 Drawing Sheets

SAND PROTECTION SYSTEM FOR ELECTRICAL SUBMERSIBLE PUMP

TECHNICAL FIELD

This invention relates to a method and apparatus for removing sand that collects below an electrical submersible pump in a well. In particular, the invention relates to a method and apparatus for separating sand from well fluids and then pumping the separated sand to the surface.

BACKGROUND ART

Electrical submersible pumps are widely used in oil wells. It is desirable to remove sand and other solid particles from well fluids before they enter the submersible pump since sand causes wear and plugging of the pump and other components. The subsequent repairs or replacement of a downhole pump can be expensive due to labor, parts costs and loss of production.

During oil production from a well, oftentimes sand or other particles that are entrained with well fluids are pumped through the downhole pump. Various sand control systems have been implemented to stop or reduce sand flow into the wellbore. Screens or filter openings have been utilized in the casing or other members to restrict the flow of solid particles. In many wells, the quantity of sand flowing from the formation is relatively small, but is sufficient to wear or plug the downhole pump. One solution is to provide a separator, such as a hydro-cyclone separator to separate sand from well fluids that enter the wellbore.

Once the sand is separated from the fluids, the separated sand will settle out within the wellbore. If large quantities of sand are produced, then it may be necessary to remove sand from the wellbore. Since it is expensive to cease production and pull the electrical submersible pump, it is desirable to utilize a method and apparatus for removal of the sand without pulling the electrical submersible pump.

DISCLOSURE OF INVENTION

An electrical submersible pump (ESP) is suspended on a flow conduit within a well. A separator is provided to separate sand from well fluids before the well fluids enter the pump. A bypass tube is connected from the flow conduit above the pump to a location below the pump where the sand is collected. The electrical submersible pump may be turned off to allow fluid levels within the flow conduit to equalize. The flow conduit is then pressurized at the surface to cause a downward flow of well fluid in the flow conduit below an equilibrium point for the well fluid. After lowering the level of fluid within the flow conduit, the pressure within the flow conduit is then relieved, which causes well fluid to flow back up through the bypass tube to the flow conduit. The upward flow of well fluid results in sand being drawn up the bypass tube into the flow conduit above the pump. The fluid and sand are routed through the bypass tube rather than through the pump since the flow path through the pump is obstructed. A check valve in the bypass tube prevents back-flow of sand and fluid through the bypass tube after the sand and fluid have flowed up through the bypass tube into the flow conduit. Once the fluid and sand have flowed into the flow conduit above the pump, the pump may be restarted and the sand and fluid in the flow conduit may be pumped to the surface.

DETAILED DESCRIPTION OF THE INVENTION

Figure 1:
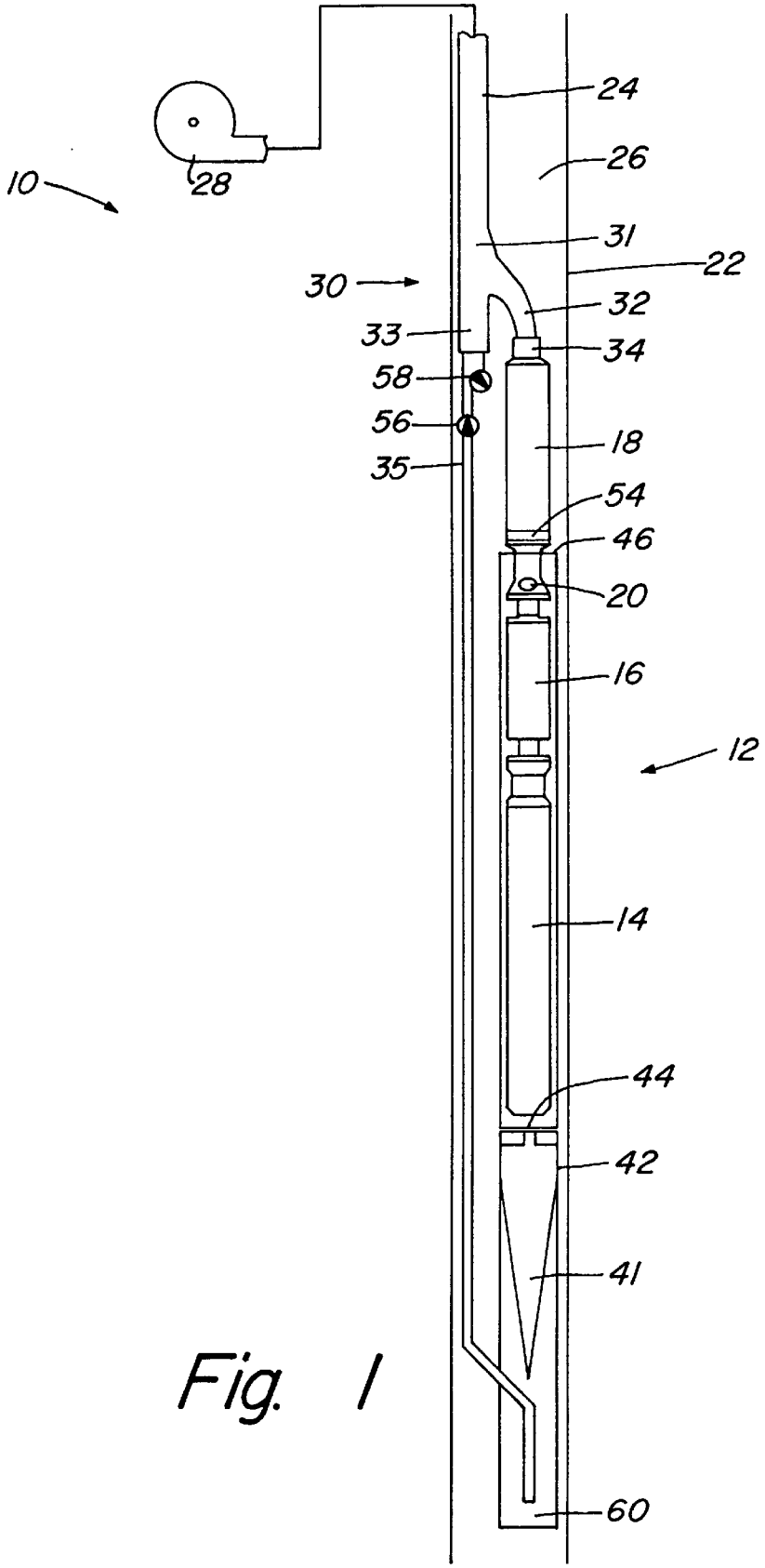
FIG. 1 shows a schematic drawing of a sand evacuator system of the invention that utilizes a shroud over the electrical submersible pump assembly.
Figure 2:
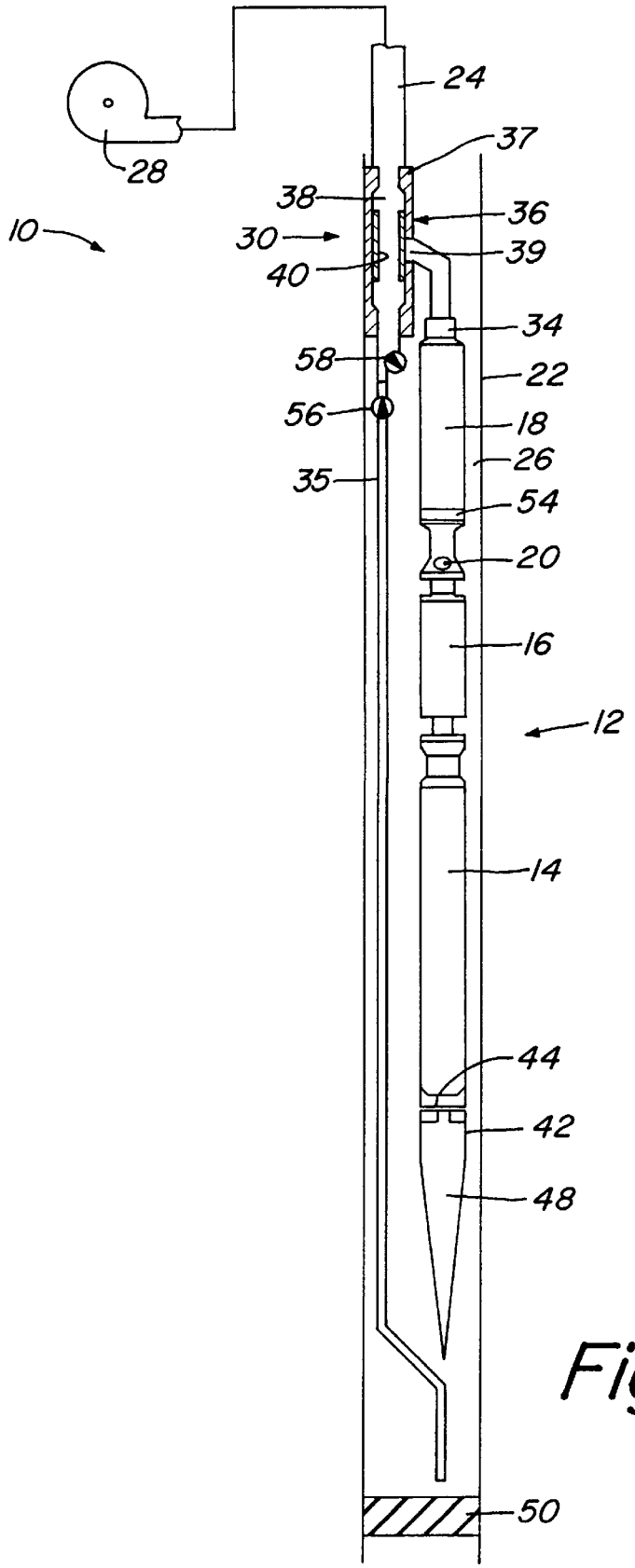
FIG. 2 shows a schematic representation of an alternate embodiment of the sand evacuator system of the invention wherein a separator is mounted within the casing on a packer.

Referring to FIGS. 1 and 2, shown is a well 10 having a sand protection system for an electrical submersible pump (ESP) 12. The ESP 12 has a motor 14, a seal section 16, and a pump 18 having an intake 20. The well 10 has a casing 22 and a flow conduit 24, such as tubing, that extends through casing 22. The flow conduit 24 and casing 22 define a casing annulus 26 that surrounds flow conduit 24. A compressor or pump 28 communicates with an upper end of flow conduit 24 for pressurizing the flow conduit 24 as desired. A valve 30 is located on a lower end of flow conduit 24. Valve 30 may be a Y-tool 31 (FIG. 1) having a first leg 32 and a bypass leg 33. A first tube 34 and a bypass tube 35 communicate with Y-tool 31. First leg 32 communicates with first tube 34 and bypass leg 33 communicates with bypass tube 35. The electrical submersible pump 12 is located within first tube 34. Valve 30 may also be a sliding sleeve valve 36 (FIG. 2). Sliding sleeve valve 36 has a housing 37 defining a passageway 38 and port 39. Sleeve 40 is slidingly received within sliding sleeve valve 36 to selectively close off port 39. Passageway 38 communicates with bypass tube 35 and port 39 communicates with first tube 34.

A hydro-cyclone separator 41 (FIG. 1) is provided below the electrical submersible pump 12. The separator 41 separates solids, such as sand, from well fluids. The separator 41 has a mixed fluids inlet 42 and a first outlet 44 that transmits fluids upward past the motor 14 and seal section 16 to be drawn in by intake 20 of pump 18 of the electrical submersible pump 12. The hydro-cyclone separator 41 is affixed to a shroud 46 (FIG. 1) that surrounds the electrical submersible pump 12. Separated well fluid is delivered out of first outlet 44 into shroud 46 (FIG. 1).

Referring now to FIG. 2, in an alternate embodiment, the hydro-cyclone separator 48 may be positioned within casing 22 above a packer 50. Bypass tube 35 communicates with valve 30, such as sliding sleeve valve 36, and extends to a location below separator 48 in FIG. 2 to a location proximate the separated solids. Sliding sleeve valve 36 or Y-tool 31 may be used with or without shroud 46. Y-tool 31 is shown in conjunction with shroud 46 as an example only.

Additionally, the invention may include a flow inhibitor 54 positioned in a flow path through pump 18 of ESP 12 to encourage flow through bypass tube 35. In a preferred embodiment, a check valve 56 is located in bypass tube 35 to prevent backflow through bypass tube 35. A second check valve 58 may be provided in bypass tube 35 to restrict flow from casing annulus 26 into bypass tube 35. Second check valve 58 allows backflow from bypass tube 35 to flow into casing annulus 26. A sand chamber 60 is provided in the lower end of shroud 46 (FIG. 1) to collect separated solids such as sand. In the embodiment without shroud 46 (FIG. 2), sand collects above packer 50.

In operation, bypass tube 35 is connected from the flow conduit 24 above the pump 18 of ESP 12 to a location near the separated sand. The separated sand may be in sand chamber 60 (FIG. 1) or may be located above packer 50 within casing 22 (FIG. 2). Once it is determined that the separated sand is to be removed, the electrical submersible pump 12 is turned off. Preferably, fluids within the well 10 are allowed to equalize to an equilibrium point. The flow conduit 24 is then pressurized by pump 28 at the surface. The flow conduit 24 is preferably pressurized by pumping a gas into flow conduit 24. The pressure in flow conduit 24 results in a downward flow of well fluid within the flow conduit 24 to a point below the equilibrium point for the well fluid. The downward flow of well fluids is preferably routed through pump 18. The bypass tube 35 is kept open and the pressure from the surface on the flow conduit 24 is then relieved. Once the pressure within the flow conduit 24 is relieved, the well fluid will flow back up the flow conduit 24 to its equilibrium point. The upward flow of well fluid will draw sand and fluid up the bypass tube 35 into the flow conduit 24 above the pump 18. Well fluid flows through bypass tube 35 instead of through first tube 34 since components within ESP 12 provide resistance to flow. To better facilitate flow up bypass tube 35, a flow inhibitor 54 may be provided to further inhibit flow up through the first tube 34 of the system.

A check valve 56 prevents backflow of sand back down the bypass tube 35. A second check valve 58 may be provided to allow fluids to pour back into the casing annulus 26 in the embodiment of FIG. 1 that utilizes a shroud 46. After the sand and fluids have flowed up the bypass tube 35, the pump 18 of the ESP 12 may be started to pump the sand up the flow conduit 24 to the surface.

The invention has several advantages. The use of a separator prevents sand from entering into a submersible pump, which increases the life of the pump. The bypass tube allows for the removal of separated sand from the well without pulling the ESP. The result is an increase in efficiency and lower cost to an operator.

While the invention has been shown in only one of its forms, it should be apparent to those skilled in the art that it is not so limited, but is susceptible to various changes without departing from the scope of the invention.

What is claimed is:

1. A method of removing sand collected below an electrical submersible pump that pumps well fluid through a flow conduit to surface level comprising:

(a) connecting a bypass tube from the flow conduit above the pump to a vicinity of the sand;

(b) turning off the electrical submersible pump; then (c) pressurizing the flow conduit at the surface to cause a downward flow of the well fluid in the flow conduit below an equilibrium point for the well fluid; then (d) while the bypass tube is open, relieving the pressure, causing the well fluid to flow back up the flow conduit to its equilibrium point, and drawing sand up the bypass tube into the flow conduit above the pump;

(e) preventing back flow of sand back down the bypass tube; and (f) starting the pump and pumping the sand up the flow conduit to the surface.

2. The method according to claim 1 further comprising:

allowing well fluid to reach equilibrium after said step of turning off the electrical submersible pump of step (b) and before said step of pressurizing the flow conduit of step (c).

3. The method according to claim 1 wherein:

said step of pressurizing the flow conduit comprises pumping a gas down said flow conduit.

4. The method according to claim 1 wherein:

said downward flow of the well fluid in the flow conduit passes through said pump.

5. The method according to claim 1 wherein:

said step of preventing back flow of sand back down the bypass tube is comprised of blocking the back flow with a check valve.

6. A method of removing sand collected below an electrical submersible pump that pumps well fluid through a flow conduit to surface level comprising:

(a) providing a shroud that surrounds said electrical submersible pump;

(b) separating sand from well fluids with a hydro-cyclone separator provided within said shroud;

(c) connecting a bypass tube from the flow conduit above the pump to a vicinity of the sand;

(d) turning off the electrical submersible pump; then (e) pressurizing the flow conduit at the surface to cause a downward flow of the well fluid in the flow conduit below an equilibrium point for the well fluid; then (f) while the bypass tube is open, relieving the pressure, causing the well fluid to flow back up the flow conduit to its equilibrium point, and drawing sand up the bypass tube into the flow conduit above the pump;

(e) preventing back flow of sand back down the bypass tube; and (f) starting the pump and pumping the sand up the flow conduit to the surface.

7. The method according to claim 6 further comprising:

allowing well fluid to reach equilibrium after said step of turning off the electrical submersible pump of step (b) and before said step of pressurizing the flow conduit of step (c).

8. The method according to claim 6 wherein:

said step of pressurizing the flow conduit comprises pumping a gas down said flow conduit.

9. The method according to claim 6 wherein:

said downward flow of the well fluid in the flow conduit passes through said pump.

10. The method according to claim 6 wherein:

said step of preventing back flow of sand back down the bypass tube is comprised of blocking the back flow with a check valve.

11. The method according to claim 6 further comprising:

said step of separating sand from well fluids with a hydro-cyclone separator provided within said shroud comprises depositing the sand in a sand chamber provided at a bottom of said shroud.

12. A well having a sand protection system for an electrical submersible pump comprising:

casing;

a flow conduit extending through said casing and defining a casing annulus surrounding said flow conduit;

a pump in communication with an upper end of the flow conduit for pressurizing said flow conduit;

a valve affixed to a lower end of said flow conduit;

a first tube and a bypass tube in communication with said valve;

the electrical submersible pump within said first tube;

a hydro-cyclone separator for separating solids from well fluids, said hydro-cyclone separator having a mixed liquids inlet, a first outlet for delivering separated fluids to said pump and a second outlet for passing separated solids; and wherein said bypass tube extends to a location proximate said separated solids.

13. The well according to claim 12 wherein said valve is a "Y" tool having a check valve therein.

14. The well according to claim 12 wherein said valve is a sliding sleeve valve.

15. The well according to claim 12 further comprising:

a flow inhibitor in a flow path through said electrical submersible pump to facilitate evacuation of said separated solids through said bypass tube.

16. The well according to claim 12 further comprising a check valve at an upper end of said bypass tube to prevent backflow into said bypass tube.

17. The well according to claim 12 further comprising:

a second check valve in said bypass tube that allows backflow to a casing annulus.

18. The well according to claim 12 further comprising:

a shroud surrounding said electrical submersible pump that prevents fluids from entering at a top of said shroud.

19. The well according to claim 18 further comprising:

a sand chamber at a bottom of said shroud for receiving said separated solids from said hydro-cyclone separator.

* * * * *